United States Patent [19]

Dunning, III

[11] 3,965,499

[45] June 29, 1976

[54] CONVERTIBLE SOFA

[75] Inventor: John M. Dunning, III, Greensboro, N.C.

[73] Assignee: Dunning Ltd., East Sanford, N.C.

[22] Filed: Apr. 18, 1975

[21] Appl. No.: 569,469

[52] U.S. Cl. ..... 5/13; 5/18 R; 5/29

[51] Int. Cl.[2] ..... A47C 17/14

[58] Field of Search ..... 5/13, 17, 18, 29, 31, 5/41

[56] References Cited

UNITED STATES PATENTS

| | | | |
|---|---|---|---|
| 2,584,145 | 2/1952 | Martin | 5/14 |
| 2,783,479 | 3/1957 | Bartolucci | 5/18 R |
| 3,771,178 | 11/1973 | Inman | 5/13 |

*Primary Examiner*—Casmir A. Nunberg

[57] ABSTRACT

The bed or mattress frame for a convertible sofa is formed of at least two flat spring sections hinged along adjacent longitudinal edges and foldable into a storage position with the spring sections arranged in flat, overlying relationship with each other behind the front board of the sofa. As the sections are unfolded, a linking bar at each end of the frame activates a pivotally attached lever to lift the spring sections to a level above the front board.

4 Claims, 7 Drawing Figures

CONVERTIBLE SOFA

BACKGROUND OF THE INVENTION

In the development of sofas which are convertible into beds, hereinafter referred to as convertible sofas, it has become conventional to utilize a folding mattress frame formed of a plurality of spring sections which can be folded up into a sofa position and stored in the seat beneath the seat cushions of the sofa, or can be selectively unfolded into a bed position. to effect conversion of such a sofa to a bed, the mattress frame is lifted out of the storage position beneath the seat and one of the spring sections unfolded forwardly of the sofa into the room. In the closed position, the mattress frame generally forms the base for the seat cushions of the sofa.

In an effort to maximize comfort of the sofa when in the bed position, it has become the practice to use rather large and bulky mattresses that remain with the spring section in the closed position. Such an arrangement requires a relatively large front board, or else the sofa must be upholstered and include a skirt all the way to the floor to hide the mattress and frame behind the front section. It is apparent that in such an arrangement, the design possibilities are severely limited, and a "high leg" design, convertible sofa has not been possible.

Moreover, conventional convertible sofas take up a considerable amount of floor space in a room in the open or bed position, on the order of 2–3 times the space taken up by the couch alone. The reason for the large amount of floor space is that the mattress frame folds out of the sofa to move clear of the rear upholstered back cushions which remain with the couch. With the added weight of the mattress and several linkages and springs, the mattress frame is heavy and difficult to convert from one position to the other.

SUMMARY OF THE PRESENT INVENTION

The convertible sofa, according to the present invention, however, overcomes these problems in that there is provided a very light-weight, easily convertible spring section. The convertible sofa of the present invention includes a mattress frame that is much more compact when folded into the sofa position than is the case with known convertible sofas. The spring sections which form the mattress frame fold together in relatively flat, overlying relationship with no mattress therebetween and therefore take up a minimum amount of vertical space in the bottom of the sofa. Thus the design possibilities of sofas made in accordance with the present invention are considerably expanded. It is now possible to design contemporary, exposed wood furniture wherein the front board is relatively narrow, and needs no upholstery thereover or skirt extending to the floor to hide a bulky mattress frame. Yet, when unfolded into the bed position, the present construction provides a sturdy mattress frame that is easily lifted out of its normal folded position behind the front board into the unfolded position. During such movement, the rear or lower spring section is automatically elevated to a position above the front board, so that no damage occurs thereto.

In general, the convertible sofa according to the present invention includes a sofa frame and a bed or mattress frame having at least two rectangular spring sections hinged together along corresponding longitudinal edges adjacent the front board. The bed frame is movable between a folded up, sofa position and an opened, bed position. In the folded, sofa position the upper and lower frame sections fold together in flat, overlying relationship with relatively no space therebetween and can be easily stored behind and beneath the lower edge of the front board.

When the bed frame is moved to the opened position, the upper spring section folds out and away from the lower section. The lower spring section includes a lever arm or jack pivotally attached at each end of the spring section upon which the section rests on a bracket affixed to the sofa frame. A connecting link between the upper spring section and the lever activates the lever to an upright position to elevate the lower spring section to a point above the upper edge of the front board. At the same time a pair of legs are folded out from the front edge of the upper frame, so that the entire bed or mattress frame is situated in a level, planar position above the upper edge of the foot board. The seat and back cushions of the sofa are then arranged on the frame, and a cover member is implaced over all six cushions to form a comfortable mattress thereon.

It is therefore an object of the present invention to provide an improved construction for convertible sofas.

It is another object of the present invention to provide a convertible sofa having a bed frame construction which facilitates fréer design possibilities than heretofore known.

It is another object of the present invention to provide a convertible sofa of the type described in which the mattress frame, when folded in the sofa position, includes a plurality of spring sections arranged in flat, overlying, substantially coplanar relationship, wherein the total vertical dimension of the mattress frame may be minimized.

It is yet another object of the present invention to provide a convertible sofa of the type described in which, as the mattress frame is unfolded, the entire frame is moved from a lower position behind the front board of the sofa to an elevated, planar position above the upper edge of the front board of the sofa.

Other objects and a fuller understanding of the present invention will become apparent from reading the following detailed disclosure of a preferred embodiment along with the accompanying drawings in which.

DETAILED DISCLOSURE OF THE PREFERRED EMBODIMENT

Figure 1:
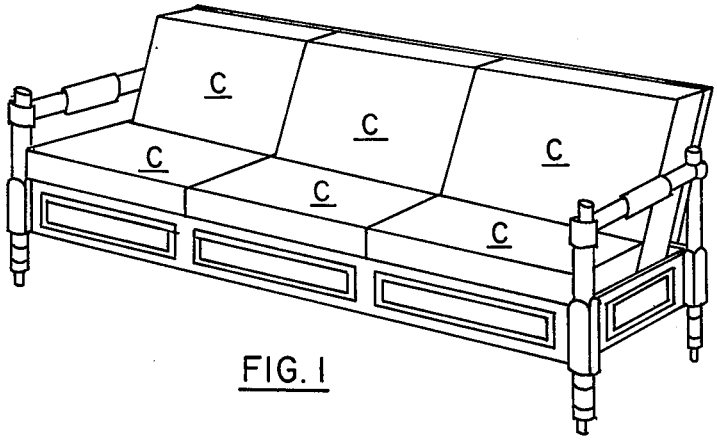
FIG. 1 is a perspective view illustrating the convertible sofa according to the present invention in the sofa position.
Figure 2:
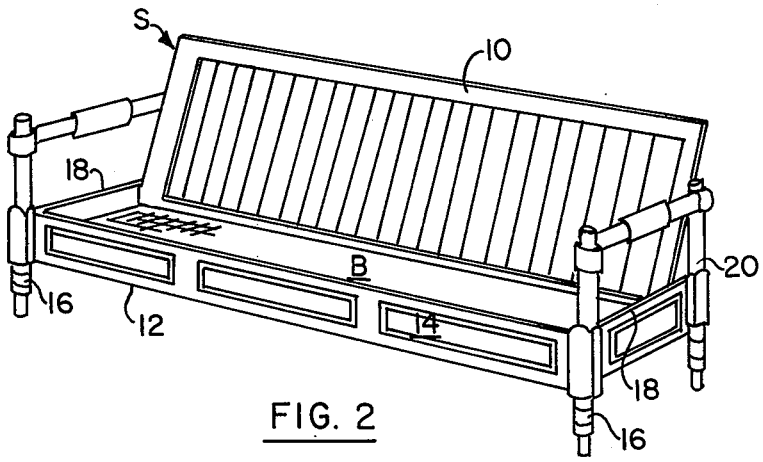
FIG. 2 is a perspective view, similar to FIG. 1, except illustrating the sofa, still in the sofa position, but with the sofa pillows removed preparatory to unfolding the sofa to the bed position.
Figure 3:
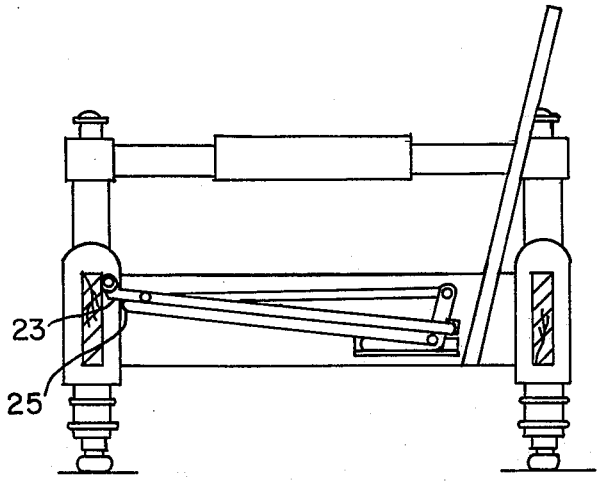
FIG. 3 is a sectional view taken substantially along lines 3—3 in FIG. 2.

Turning now to a detailed description of a preferred embodiment, the present invention is directed to a sofa construction in which the sofa frame S includes a rear panel 10 and a seat frame 12 which includes a front board 14 having a leg 16 attached at either end thereto, and end walls 18 extending rearwardly from each front leg 16 to a rear leg 20. The bed or or mattress frame B is supported within the seat frame 12 as will be more specifically described hereinafter, and includes at least an upper and lower rectangular spring section 22,24 respectively, hinged together along corresponding longitudinal edges 23,25 adjacent the front board 14. The upper and lower spring sections 22,24 are movable between a folded, sofa position illustrated in FIG. 3 and an open, bed position illustrated in FIG. 4.

Figure 4:
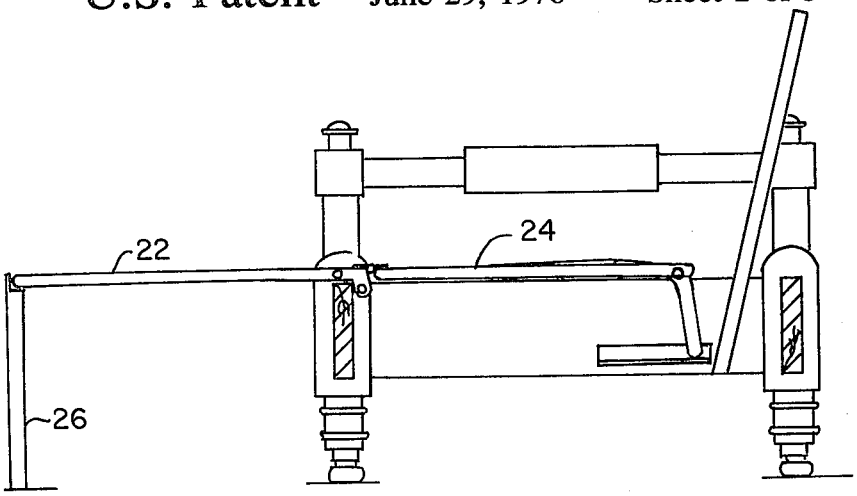
FIG. 4 is a sectional view, similar to FIG. 3, except illustrating the bed frame in the unfolded or open position.

In the folded, sofa position spring sections 22,24 are folded closely adjacent each other in flat, overlying relationship with relatively no space therebetween, and stored in concealed position behind front board 14. As used herein the phrase "folded closely adjacent each other in flat overlying relationship" means that in the folded position the two spring sections are substantially contiguous, so that the vertical dimension of the folded bed frame (sometimes referred to as thickness) is no more than the sum of the corresponding dimensions of the spring sections. In the open position, frame sections 22,24 are raised by an elevating means responsive to the opening operation through an activating means to a horizontal, planar position above the level of front board 14 as illustrated in FIG. 4.

Turning now to the specifics of the individual components, the upper spring section 22 includes a front rail 30, a rear rail 32, side rails 34 and a plurality of springs and reinforcing slats 36 extending between front, rear, and side rails 30, 32, and 34. Similarly, the lower spring section 24 includes a front rail 40, a rear rail 42, side rails 44, and a plurality of springs and reinforcing slats 46 extending therebetween. One or more hinges 48 pivotally join the front rails 30,40 together at spaced positions therealong, so that the frames separate from the rear thereof and when opened, the front rails 30,40 lie side by side with the two spring frames 22,24 forming a generally horizontal planar mattress frame.

Figure 6:
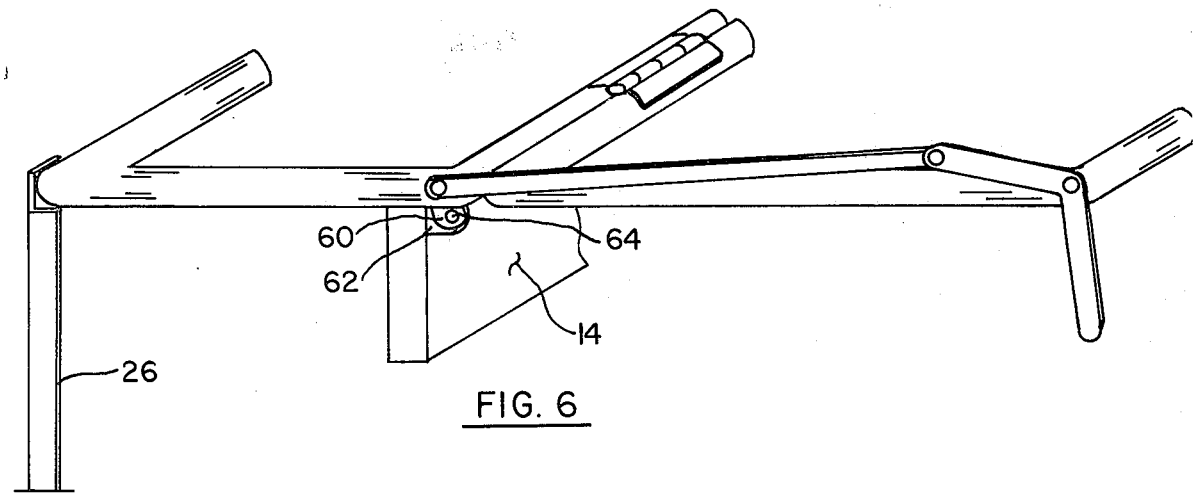
FIG. 6 is an enlarged perspective view, similar to FIG. 5, except showing the bed frame in the unfolded position.

The elevating means includes an L-shaped elevating lever or jack 50 pivotally secured by means of a connecting pin 52 to the rear end of side rail 44 adjacent the junction of side rail 44 with rear rail 42. One end, the upper end, of lever 50 is connected to the activating means, which includes a linking bar 54 joining the upper end of lever 50 with the side rail 34 of spring section 22 near the front end thereof by means of a similar pivotal connecting pin 56. The opposite or free end of lever 50 engages a bracket rail 58, connected to the side wall 18 of the sofa frame to effect the elevating operation. So arranged, as the upper spring section 22 is lifted and moved to the unfolded position, linkage 54 pulls at the upper end of lever 50 causing the pivot point at pin 52 to be raised as the lever is lifted to an upstanding position on bracket 58. (FIGS. 4, 6).

Figure 5:
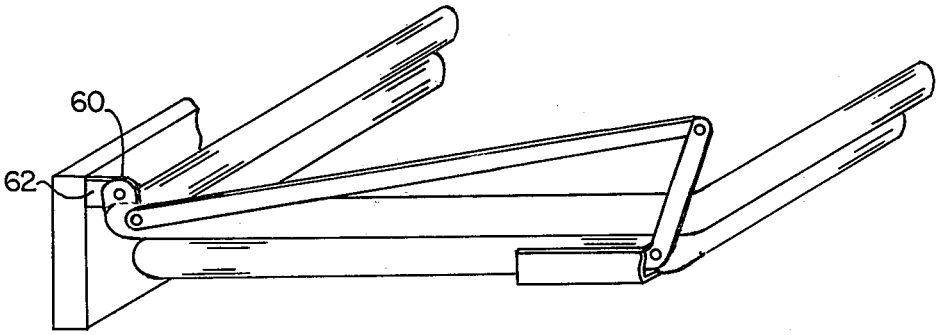
FIG. 5 is an enlarged perspective view illustrating one end of the bed frame, in the folded position.
Figure 7:
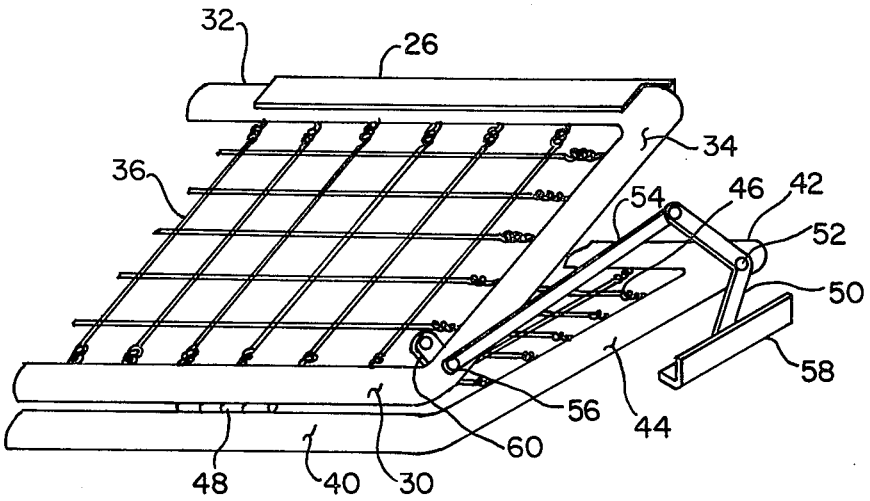
FIG. 7 is an enlarged perspective view, similar to FIGS. 5 and 6, except illustrating the bed frame in the partially folded position.

In order to lift the front portion of the mattress frame B simultaneously with the operation of lifting lever or jack 50, each side rail 34 of upper spring section 22 includes an upstanding tab 60 at the front end thereof. A bracket member 62 connected to the rear of front rail 14 includes a connecting pin 64 extending through a pivot point in tab 60, and pivotally attaching the tab 60 to the sofa frame. Throughout operation of the sofa, the pivot point in tab 60 remains fixed slightly below the upper edge of front rail 14. When upper spring section 22 is rotated to the bed position, the section 22 rotates around the above defined pivot point, so that the tab is then in a downwardly extending position (FIGS. 4, 6). The front rail 30 is then in a position above front rail 14, and since the front rail 40 of the lower spring section 24 is hinged to front rail 30 of the upper section 22, the front portion of lower spring section 24 is also elevated to the same level as upper section 22. Although only one end of the supporting structure of the bed frame is illustrated in FIGS. 5–7, it is understood that the opposite end is constructed in the same manner so that each end has its own elevating and activating means.

The sofa S is converted from the sofa position to the bed position in the following manner. First the seat and rear cushions C are removed. The rear side 32 of upper spring section 22 is then lifted and folded over to the opened position. As this is done, the connecting linkage 54 automatically pivots the lifting lever 50 to the upstanding position so that the lower spring section 24 is elevated to its uppermost position on a level with the upper section 22, which, in turn, is supported at its outer end by means of a pair of corner legs 26. The sofa cushions, both back and seat are then arranged on the bed frame, and a cover, not shown, is applied over the cushions to retain them in assembled condition. Although not illustrated, bed frame B could be formed of three or more spring sections, constructed and operated in a manner similar to that described hereinabove to provide a larger sleeping surface. Further, it is apparent that persons sleeping on the sofa bed would lie parallel to rear panel 10, rather than transverse thereto. Since the rear cushions are removed as well as the seat cushions, the bed frame does not have to move forwardly away from the rear panel, and considerably less room space is required to convert the sofa to the bed or sleeping position.

Various other changes and modifications may be made to the preferred embodiment described hereinabove without departing from the scope of the present invention, which is set forth in the appended claims.

What is claimed is:

1. A convertible sofa comprising:

a. a sofa frame including a front board and end walls extending rearwardly therefrom;

b. a bed frame mounted within said sofa frame behind said front board and between said end walls and comprising at least an upper and lower spring section hinged together along corresponding longitudinal edges adjacent said front board;

c. said spring section being movable with relation to each other between a folded, sofa position and an open, bed position;

d. said upper and lower spring sections, in said sofa position, being folded closely adjacent each other in flat, overlying relationship behind and beneath the upper edge of the front board;

e. an elevating means connecting said upper and lower spring sections for raising said lower spring section above the upper edge of said front board said elevating means including a lever means supported by said sofa frame pivotally attached to said lower spring section and movable between a lowered position and an upstanding position, and an activating means connecting said lever means with said upper spring section for activating said lever means responsive to unfolding of said upper spring section.

2. The convertible sofa according to claim 1 wherein said activating means comprises a linkage bar connecting one end of said lever means with said upper spring section, the other end of said lever means engaging said sofa frame, and said lever means being pivotably attached to said lower spring section at a point between the ends of said lever means.

3. The convertible sofa according to claim 1 wherein said upper and lower spring sections each include a front rail, a rear rail, a pair of side rails therebetween, said lever means comprises a generally L-shaped lever pivotally attached to each side rail of said lower spring frame through a pivot point at the intersection of the legs of said L-shaped lever, the lower leg of said lever engaging a stationary bearing surface of said sofa frame and said activating means comprises a linking bar connecting the free end of the upper leg of said L-shaped lever with the corresponding side rail of said upper spring frame, whereby movement of said upper frame rotates said lever to said upstanding position raising said pivot point, resulting in a raising of said lower spring frame.

4. The convertible sofa according to claim 3 wherein one of said L-shaped levers is attached to each of said side rails of said lower spring section adjacent the rear thereof and said activating means is attached to said side rails of said upper spring section near the front thereof, and a bracket means supported by said sofa frame and pivotally connecting the front portion of said bed frame with said upper frame, whereby as said upper spring section is moved to said open position both the front and rear portions of said lower spring section are raised to a horizontal level above said front board.

* * * * *